US007612272B1

(12) United States Patent
Lee

(10) Patent No.: US 7,612,272 B1
(45) Date of Patent: Nov. 3, 2009

(54) XYLOPHONE

(75) Inventor: James Lee, Taipei (TW)

(73) Assignee: Reliance International Corp., Taipei (TW)

( * ) Notice: Subject to any disclaimer, the term of this patent is extended or adjusted under 35 U.S.C. 154(b) by 0 days.

(21) Appl. No.: 12/268,166

(22) Filed: Nov. 10, 2008

(51) Int. Cl.
*G10D 13/08* (2006.01)

(52) U.S. Cl. ..... 84/404; 84/402

(58) Field of Classification Search ..... 84/402–404, 84/406, 408–410; 446/265, 297, 318, 397, 446/418

See application file for complete search history.

(56) References Cited

U.S. PATENT DOCUMENTS 2,287,138 A * 6/1942 Sas ..... 84/410

* cited by examiner

*Primary Examiner*—Kimberly R Lockett
(74) *Attorney, Agent, or Firm*—patenttm.us

(57) ABSTRACT

A xylophone has a frame, multiple spacers, multiple bars, multiple sleeves and multiple fasteners. The frame has two panels and multiple supports. Each support is attached between the two panels and has a top surface and a trough. The trough is longitudinally formed in the top surface of the support. The spacer is mounted in the trough of the support and has multiple protruding mounts. Each bar is mounted between two supports and has two through holes. The sleeves are respectively mounted through the through holes of the bars. Each fastener is mounted through the sleeves and in the protruding mounts of the spacers to fasten the bars on the supports of the frame. Therefore, the spacers are not moved during production for improved production consistency.

15 Claims, 7 Drawing Sheets

XYLOPHONE

BACKGROUND OF THE INVENTION

1. Field of the Invention

The present invention relates to a xylophone, especially to a xylophone with reduced manufacturing costs.

2. Description of the Prior Arts

With reference to FIGS. 5 to 7, a xylophone in accordance with the prior art has a frame (90), multiple spacers (91), multiple bars (92), multiple sleeves (93) and multiple screws (94).

The frame (90) has two panels (902) and multiple supports (901). The panels (902) are parallelly disposed and one panel (902) is longer than the other. Each support (901) is mounted between the panels (902) and at least one support (901) is mounted obliquely to the other supports (901).

The spacers (91) are mounted respectively on the tops of the supports (901).

The bars (92) are mounted on two supports (901) parallel with the panels (902) and each bar (92) has two fastener holes (921).

The sleeves (93) are respectively mounted through the fastener holes (921) of the bars (92). The screws (94) are mounted respectively through the sleeves (93) and each screw (94) is fastened securely to one of the supports (901).

However, since the spacer (91) is only mounted on the top of the support (901) of the frame (90), the spacer (91) is not stable on the support (901). Therefore, when the bar (92) is fastened to the frame (90), the spacer (91) may slip causing the xylophone to be off-key and must be remanufactured.

To overcome the shortcomings, the present invention provides a to mitigate or obviate the aforementioned problems.

SUMMARY OF THE INVENTION

The main objective of the present invention is a kind of xylophone that can save the fabricating cost.

A xylophone in accordance with the present invention has a frame, multiple spacers, multiple bars, multiple sleeves and multiple fasteners. The frame has two panels and multiple supports. Each support is attached between the panels and has a top surface and a trough. The trough is longitudinally formed in the top surface of the support. The spacer is mounted in the trough of the support and has multiple protruding mounts. Each bar is mounted between two supports and has two through holes. The sleeves are respectively mounted through the through holes of the bars. The fasteners are respectively mounted through the sleeves and in the protruding mounts of the spacers to fasten the bars on the supports of the frame. Therefore, the spacers are not moved during production for improved production consistency.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
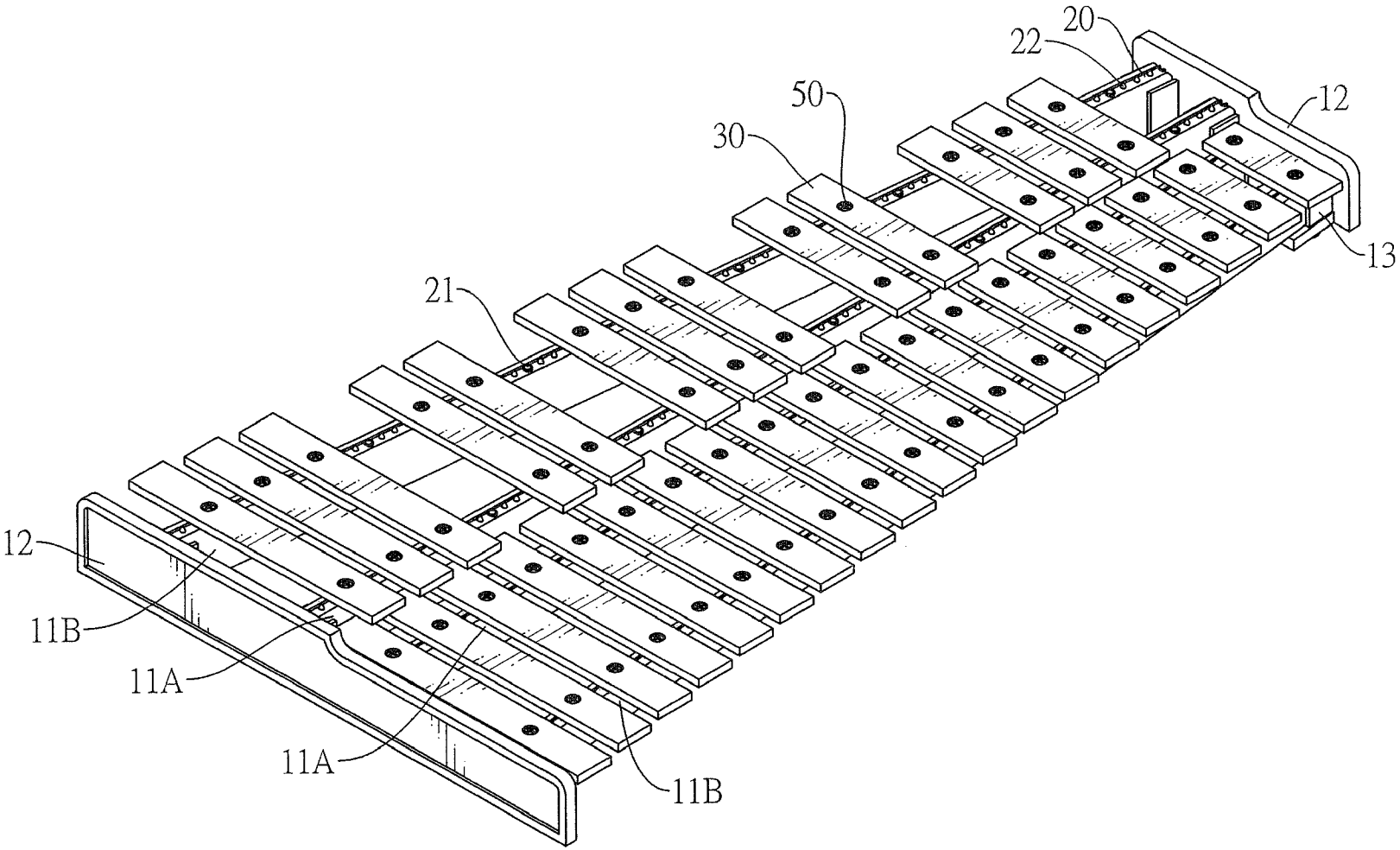
FIG. 1 is a perspective view of a xylophone in accordance with the present invention.
Figure 2:
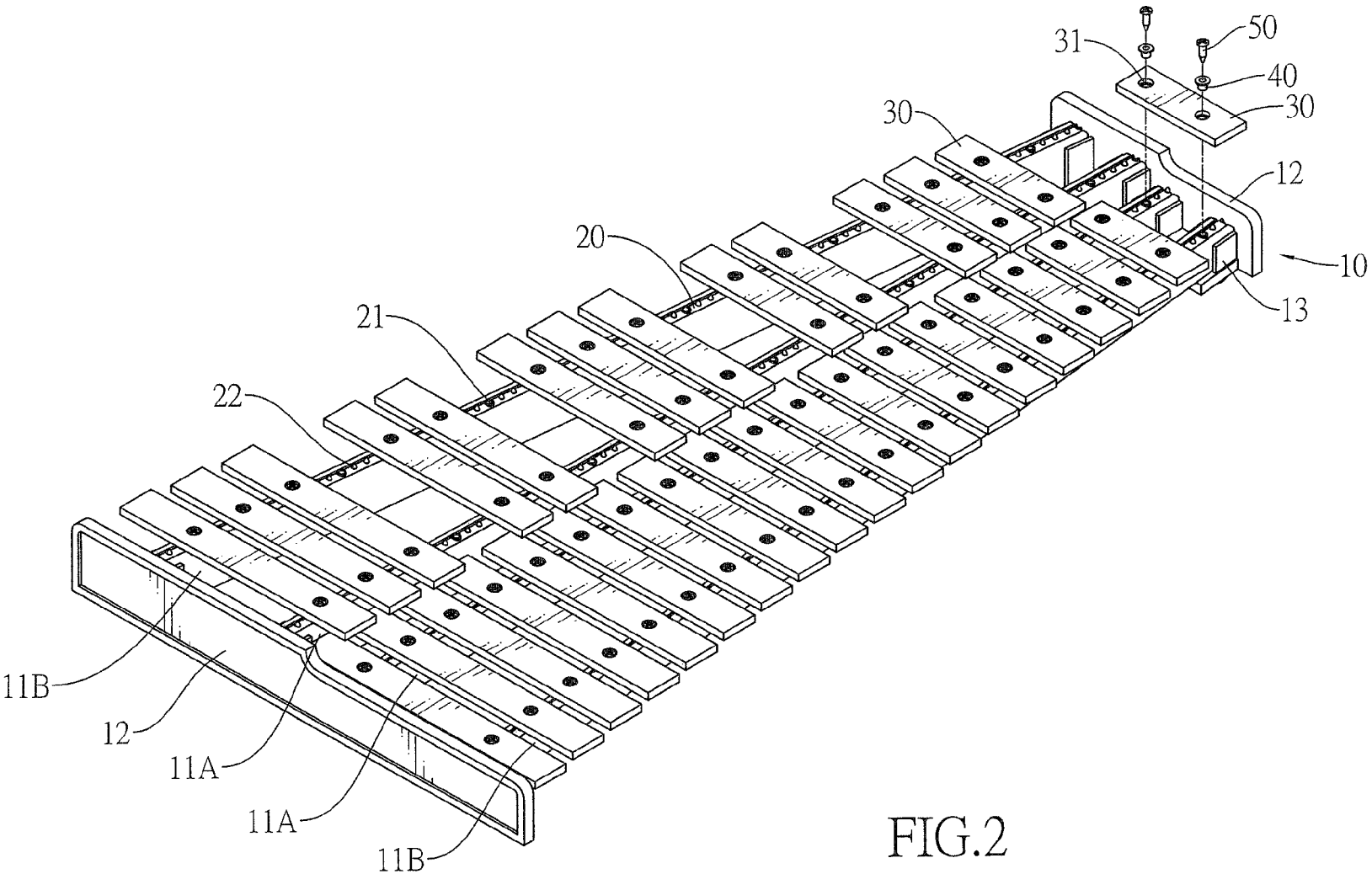
FIG. 2 is a partially exploded perspective view of the xylophone in FIG. 1.

With reference to FIGS. 1 and 2, a xylophone in accordance with the present invention has a frame (10), multiple spacers (20), two sets of bars (30), multiple sleeves (40) and multiple fasteners (50).

Figure 3:
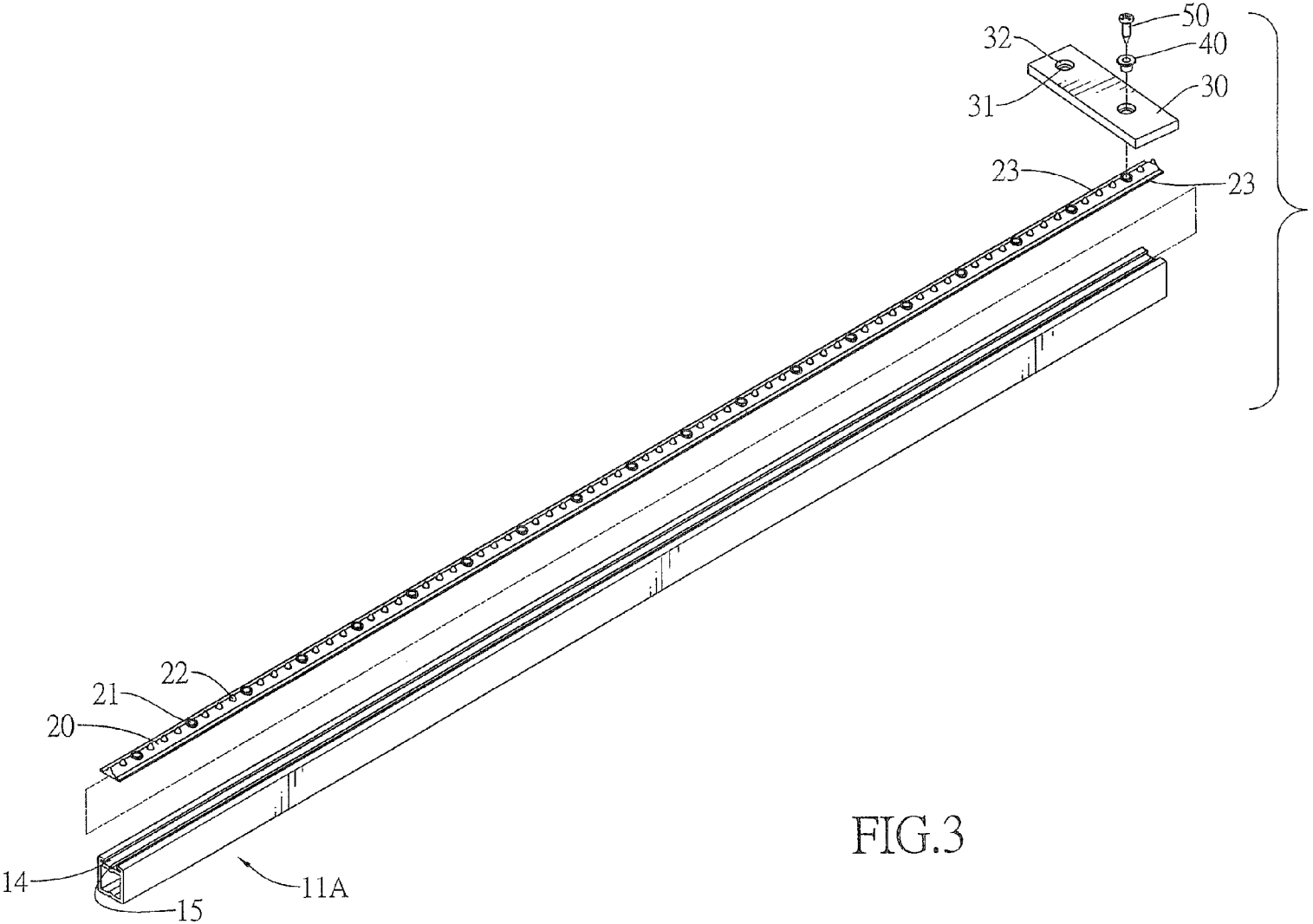
FIG. 3 is an enlarged exploded perspective view of the xylophone in FIG. 1.
Figure 4:
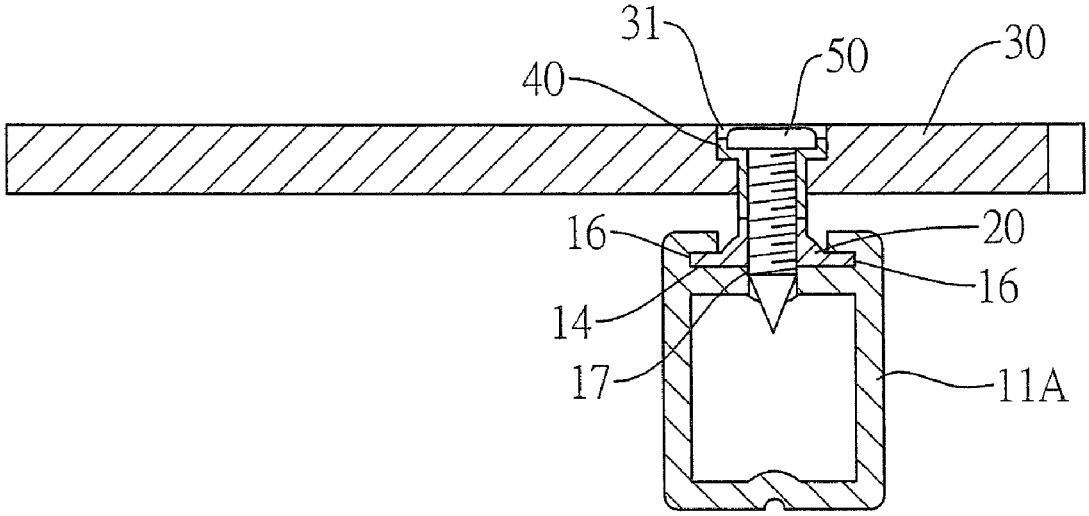
FIG. 4 is a side view in partial section of the xylophone in FIG. 1.
Figure 5:
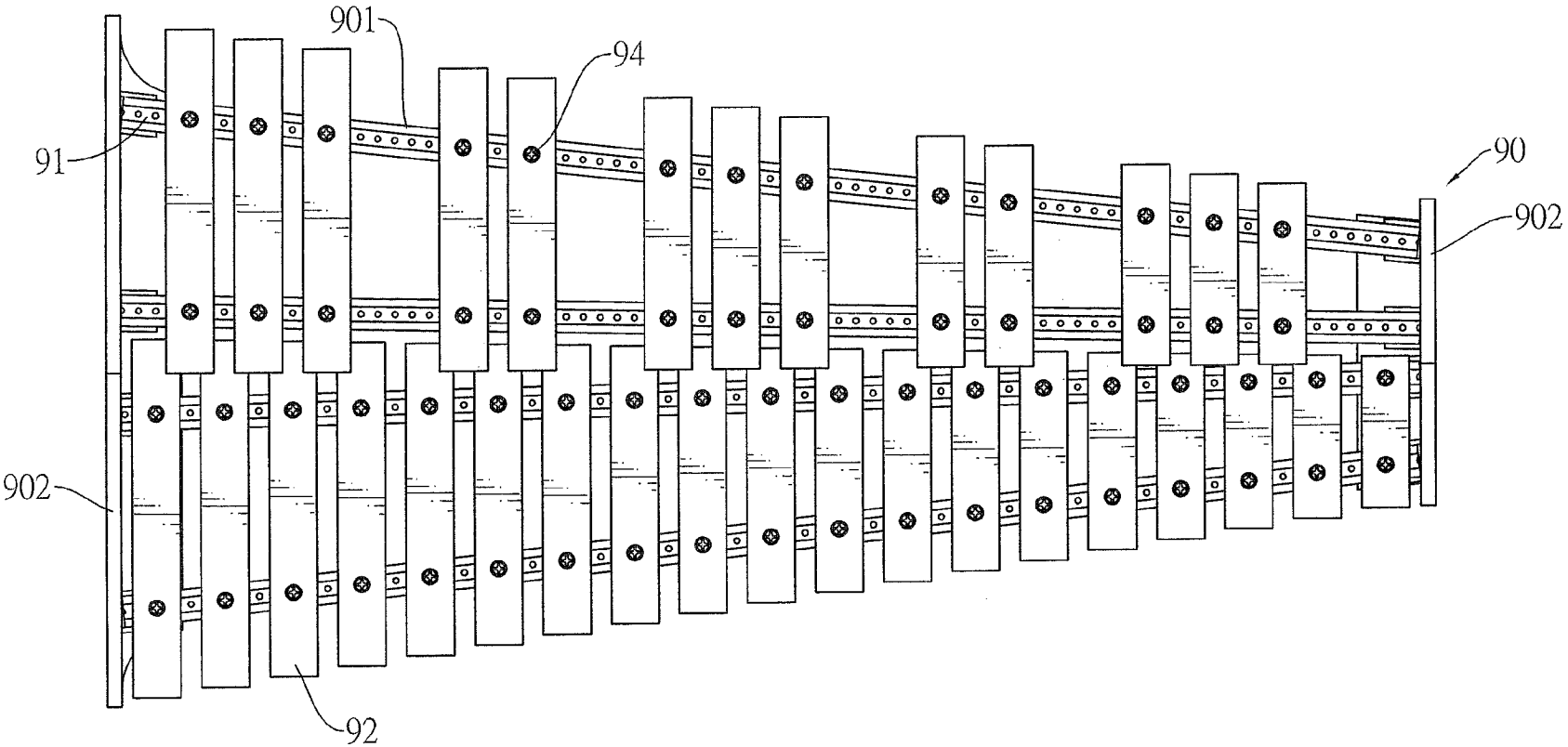
FIG. 5 is a top view of a xylophone in accordance with the prior art.
Figure 6:
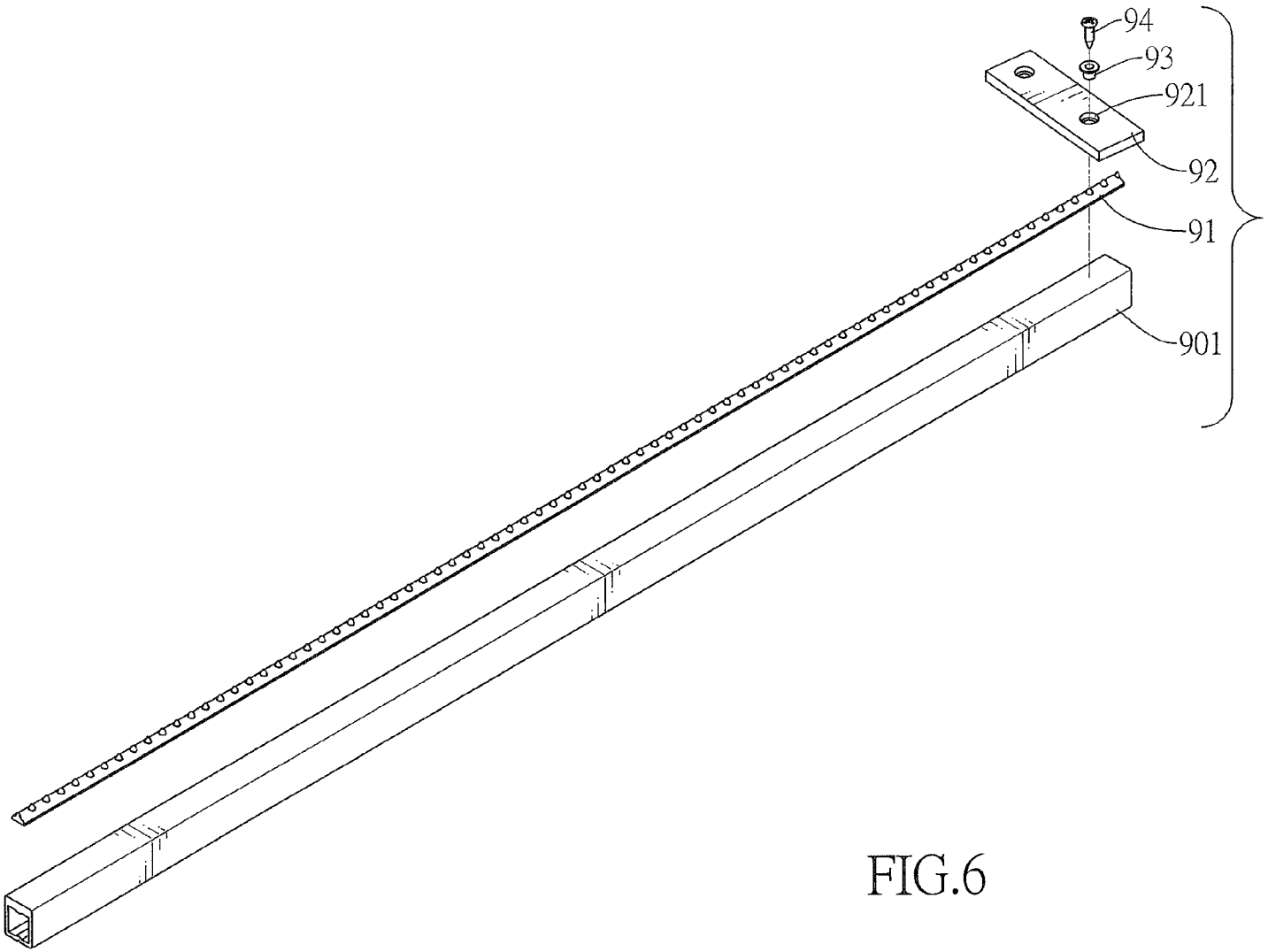
FIG. 6 an enlarged, exploded perspective view of the xylophone in FIG. 5.
Figure 7:
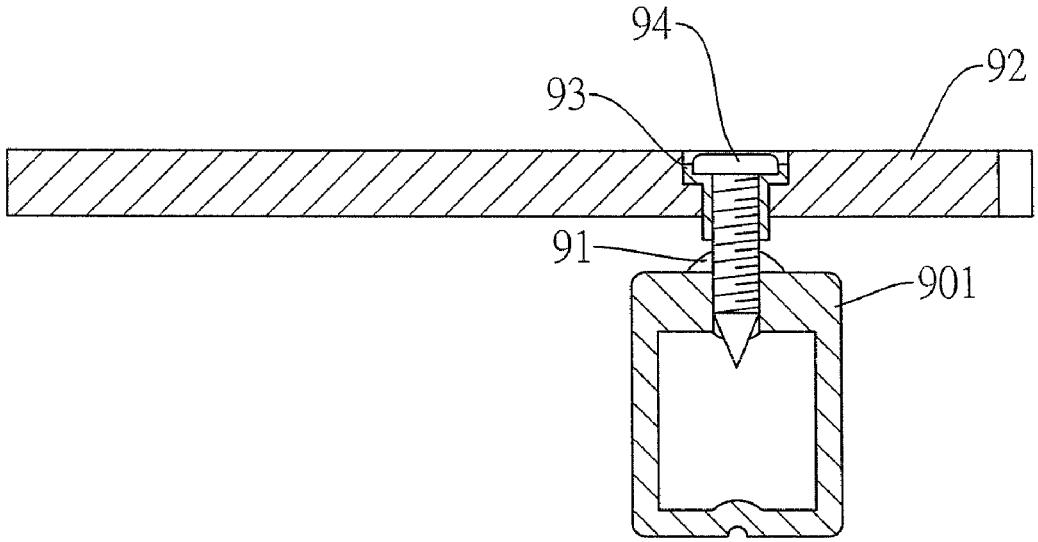
FIG. 7 is a side view in partial section of the xylophone in FIG. 5.

With further reference to FIGS. 3 and 4, the frame (10) has two panels (12) and multiple supports (11A, 11B). Each panel (12) has an inner surface and multiple seats (13). The seats (13) are mounted on the inner surface of the panel (12). The supports (11A, 11B) are attached between the two panels (12) and each support (11A, 11B) may be mounted in one seat (13) of each panel (12) and has a top surface and a trough (14). The trough (14) is longitudinally formed in the top surface of the support (11A, 11B) and may comprise a groove (15), two guide channels (16) and a fastener channel (17). The groove (15) is formed longitudinally in the top surface of the support (11A, 11B) and has two sides and a bottom. The guide channels (16) are formed respectively in the sides of the groove (15). The fastener channel (17) is formed centrally in the bottom of the groove (16).

Four seats (13) may be implemented on each panel (12) two being mounted centrally on the panel and two being mounted respectively adjacent to edges of the panel (12). The supports (11A, 11B) may be two pairs of supports (11A, 11B) and each pair has a primary support (11A) and a secondary support (11B). The primary supports (11A) are mounted respectively in the seats (13) mounted substantially centrally on the panels (12). The secondary supports (11B) are longer than the primary supports (11A), are mounted in the seats (13) mounted on the edges of the panels (12) and are located adjacent respectively to the primary supports (11A).

The spacers (20) are respectively mounted in and correspond respectively to the troughs (14) of the supports (11A, 11B) and each spacer (20) has a top surface, two edges, multiple protruding mounts (21), multiple protrusions (22) and two shoulders (23). The protruding mounts (21) are formed on and protruding from the top surface of the spacer (20) and each protruding mount (21) has a hole formed therethrough and correspond respectively to a position for required pitch. The protrusions (22) are formed at intervals on and protrude from the top surface of the spacer (20). The shoulders (23) are respectively formed on the edges of the spacer (20) and are mounted respectively in the guide channels (16) of a corresponding trough (14) to facilitate holding the spacer (20) in the corresponding trough (14).

The sets of the bars (30) may be rectangular and are mounted respectively on and correspond respectively to the pairs of the supports (11A, 11B). Each bar (30) rests on at least one of the protrusions (22) of each spacer (20) on the supports (11A, 11B) of a corresponding pair and has a top surface, two ends, two through holes (31) and two countersinks (32). Each through hole (31) is formed through the top surface of the bars (30) respectively adjacent to the ends. The countersinks (32) are formed respectively in the top surfaces of the bars (30), respectively around the through holes (31). Each bar (30) may be mounted between one primary support (11A) and one secondary support (11B).

The sleeve (40) are respectively mounted through the through holes (31) of the bars (30) and may respectively abut the protruding mounts (21).

The fasteners (50) may be screws and are mounted respectively through the sleeves (40) and securely in the protruding mounts (21) of the spacers (20) to fasten the bar (30) on the support (11A, 11B) of the frame (10) and the fasteners (50) may further protrude into the fastener channel (17) of the trough (14).

Since the spacer (20) is mounted in the trough (14) of the support (11A, 11B), the protrusion (21) is in the position for required pitch. Therefore, the spacer (20) remains in position during fastening to ensure a finished product conforms to the required standards, therefore reducing production costs.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A xylophone comprising
a frame having
two panels, each panel having an inner surface and two edges; and
two pairs of supports being attached between the two panels and each support having
a top surface; and
a trough being longitudinally formed in the top surface of the support;
multiple spacers being respectively mounted in and corresponding respectively to the troughs of the supports and each spacer having
a top surface;
a two edges;
two sets of bars being mounted respectively on and corresponding respectively to the pairs of the supports and each bar having
a top surface;
two ends; and
two through holes being formed through the top surface of the bar respectively adjacent to the ends;
multiple sleeves being respectively mounted through the through holes of the bars; and
multiple fasteners being respectively mounted through the sleeves.

2. The xylophone as claimed in claim 1, wherein
the trough of each support comprises
a groove being formed longitudinally in the top surface of the support and having two sides; and
two guide channels being respectively formed in the sides of the groove; and
each spacer further has two shoulders being respectively formed on the edges of the spacer and mounted in the guide channels of a corresponding trough.

3. The xylophone as claimed in claim 2, wherein each spacer further has multiple protruding mounts being formed on and protruding from the top surface of the spacer and each protruding mount having a hole formed through the protruding mount.

4. The xylophone as claimed in claim 1, wherein each spacer further has multiple protrusions being formed at intervals on and protruding from the top surface of the spacer.

5. The xylophone as claimed in claim 2, wherein each spacer further has multiple protrusions being formed at intervals on and protruding from the top surface of the spacer.

6. The xylophone as claimed in claim 3, wherein each spacer further has multiple protrusions being formed at intervals on and protruding from the top surface of the spacer.

7. The xylophone as claimed in claim 4, wherein
each panel further has multiple seats being mounted on the inner surface of the panel; and
each support is mounted in one of the seats of a corresponding one of the panels.

8. The xylophone as claimed in claim 5, wherein
each panel further has multiple seats being mounted on the inner surface of the panel; and
each supports is mounted in one of the seats of a corresponding one of the panels.

9. The xylophone as claimed in claim 6, wherein
each panel further has multiple seats being mounted on the inner surface of the panel; and
each support is mounted in one of the seats of a corresponding one of the panels.

10. The xylophone as claimed in claim 7, wherein
four seats are implemented on each panel, two being mounted centrally and two being mounted respectively adjacent to the edges of the panel; and
the supports are implemented as
two primary supports being mounted respectively in the seats mounted centrally on the panels; and
two secondary supports being longer than the primary supports and being mounted in the seat mounted adjacent to the edges of the panels; and each bar is mounted between one primary support and one secondary support.

11. The xylophone as claimed in claim 8, wherein
four seats are implemented on each panel, two being mounted centrally and two being mounted respectively adjacent to the edges of the panel; and
the supports are implemented as
two primary supports being mounted respectively in the seats mounted centrally on the panels; and
two secondary supports being longer than the primary supports and being mounted in the seat mounted adjacent to the edges of the panels; and each bar is mounted between one primary support and one secondary support.

12. The xylophone as claimed in claim 9, wherein
four seats are implemented on each panel, two being mounted centrally and two being mounted respectively adjacent to the edges of the panel; and
the supports are implemented as
two primary supports being mounted respectively in the seats mounted centrally on the panels; and
two secondary supports being longer than the primary supports and being mounted in the seat mounted adjacent to the edges of the panels; and each bar is mounted between one primary support and one secondary support.

13. The xylophone as claimed in claim 10, wherein each bar has two countersinks being formed in the top of the bar and located respectively around the through holes of the bar.

14. The xylophone as claimed in claim 11, wherein each bar has two countersinks being formed in the top of the bar and located respectively around the through holes of the bar.

15. The xylophone as claimed in claim 12, wherein each bar has two countersinks being formed in the top of the bar and mounted respectively around the through holes of the bar.

* * * * *